US012569042B2

(12) United States Patent
Lindsay et al.

(10) Patent No.: US 12,569,042 B2
(45) Date of Patent: Mar. 10, 2026

(54) APPARATUS AND METHOD FOR MOBILE OFFICE

(71) Applicant: World Work Stations, LLC, Flagstaff, AZ (US)

(72) Inventors: Bryan Shane Lindsay, Scottsdale, AZ (US); Jason Lindsay, Scottsdale, AZ (US)

( * ) Notice: Subject to any disclaimer, the term of this patent is extended or adjusted under 35 U.S.C. 154(b) by 0 days.

(21) Appl. No.: 18/526,953

(22) Filed: Dec. 1, 2023

(65) Prior Publication Data

US 2025/0176690 A1 Jun. 5, 2025

(51) Int. Cl.
*A45C 13/02* (2006.01)
*A45C 5/03* (2006.01)

(52) U.S. Cl.
CPC ..... *A45C 13/02* (2013.01); *A45C 5/03* (2013.01); *A45C 2013/025* (2013.01); *A45C 2013/026* (2013.01)

(58) Field of Classification Search
CPC ..... A45C 13/02; A45C 5/03; A45C 2013/025; A45C 2013/026
See application file for complete search history.

(56) References Cited

U.S. PATENT DOCUMENTS 2,005,791 A * 6/1935 Kruse ..... A45C 3/00 87/5
2,911,024 A * 11/1959 Miceli ..... A45C 13/02 D3/319
3,243,037 A * 3/1966 Luertzing ..... B65D 81/022 206/592
3,367,483 A * 2/1968 Studen ..... B65D 81/1075 217/27
4,098,312 A * 7/1978 McCain ..... A45C 11/00 150/112
4,461,332 A * 7/1984 Parkhurst ..... A45C 3/00 206/823
5,398,810 A * 3/1995 Yao Wang ..... B25H 3/023 206/371
6,237,766 B1 * 5/2001 Hollingsworth ..... A45C 13/26 190/110

(Continued)

FOREIGN PATENT DOCUMENTS

KR 20170128890 * 11/2017

OTHER PUBLICATIONS

Miika Ullakko, https://youtu.be/r2U01fJukWQ?si=Suc7fvrj-nePe3ZH, Mar. 4, 2019 (Year: 2019).*

*Primary Examiner* — Tri M Mai
(74) *Attorney, Agent, or Firm* — Enrique Monteagudo, Esq.

(57) ABSTRACT

A mobile office having a luggage insert, an insert bag, and an item of luggage. The luggage insert nestles inside the insert bag. The insert bag nestles inside the item of luggage. The luggage insert has a body with a plurality of openings extending into the body. The body includes at least one top layer and at least one lateral layer. A first top opening of the plurality of openings extends into the at least one top layer. A first lateral opening of the plurality of openings extends into the at least one lateral layer. The first top opening and the first lateral opening receive electronic office equipment. The insert bag encloses the luggage insert to retain the electronic office equipment during transport. The insert bag and luggage insert are transported in an item of luggage.

17 Claims, 6 Drawing Sheets

(56) References Cited

U.S. PATENT DOCUMENTS

| | | | | |
|---|---|---|---|---|
| 6,945,293 | B1 * | 9/2005 | Newton | A45C 13/02 190/110 |
| 2005/0121121 | A1 * | 6/2005 | Wang | A45C 5/06 190/110 |
| 2009/0266722 | A1 * | 10/2009 | Rogers | B65D 81/1275 206/521 |
| 2010/0108452 | A1 * | 5/2010 | Williams | A45C 13/02 190/115 |
| 2015/0060310 | A1 * | 3/2015 | Tseng | B65D 5/5213 206/45.23 |
| 2016/0339131 | A1 * | 11/2016 | Drake | A61L 2/24 |

* cited by examiner

APPARATUS AND METHOD FOR MOBILE OFFICE

FIELD

The present invention relates to luggage systems. More particularly, the present invention relates to a transportable office.

BACKGROUND

Luggage was developed in the 12$^{th}$ century AD as a means for transporting weapons of war. The word luggage is derived from the verb "lug", referring to the hauling of inconveniently heavy baggage. This definition has been expanded over several centuries to include various types of baggage, both large and small.

The advent and expansion of air travel throughout the world has led to the creation of luggage particularly suited to air travel, including transport in over-head compartments. Nevertheless, luggage may be used for travel by automobile, train, boat, and so forth.

Luggage is not a complete protector against all travel conditions. Hard impacts may damage luggage and further may damage the contents inside the luggage. Travelers often use luggage to transport clothing, hygiene products, and other unbreakable and/or durable objects. Travelers avoid placing fragile and/or delicate objects in the luggage. Further travelers may avoid placing expensive objects and/or objects with sentimental value in the luggage so as to avoid the risk of loss or damage.

Therefore, a need exists to improve upon the way fragile, delicate, and/or expensive objects are protected within luggage, to enable travelers more versatility to convey objects during transport of luggage.

SUMMARY

A mobile office, comprising a luggage insert having a body, the body having a plurality of openings extending into the body, the plurality of openings including at least a first top opening on a top of the body, and the plurality of openings including at least a first lateral opening on a side of the body, the plurality of openings receiving electronic office equipment, and an insert bag extendable around the luggage insert to retain the electronic office equipment during transportation.

A mobile office, comprising a luggage insert having a body, the body having a plurality of openings extending into the body, the plurality of openings including at least a first top opening on a top of the body, and the plurality of openings including at least a first lateral opening on a side of the body, the plurality of openings receiving electronic office equipment, an insert bag extendable around the luggage insert to retain the electronic office equipment during transportation, and an item of luggage capable of receiving the insert bag into an interior of the item of luggage.

A method of providing a mobile office having a luggage insert and an insert bag, the method comprising forming a body of the luggage insert, forming a plurality of openings extending into the body, the plurality of openings including at least a first top opening on a top of the body, and the plurality of openings including at least a first lateral opening on a side of the body, the plurality of openings capable of receiving electronic office equipment, and forming an insert bag capable of being extended around the luggage insert to retain the electronic office equipment during transportation.

BRIEF DESCRIPTION OF THE DRAWINGS

Various aspects and advantages will become apparent upon review of the following detailed description and upon reference to the drawings in which.

DETAILED DESCRIPTION

The present invention provides an apparatus and method for protecting fragile, delicate, and/or expensive objects (e.g., objects having electronic components). In particular, the present invention may include a luggage insert that receives one or more objects. The luggage insert may be enclosed within an insert bag. The luggage insert and insert bag may be dimensioned appropriately to fit (e.g., snuggly) within an item of luggage. Collectively, the luggage insert, the insert bag, and the item of luggage may serve to protect the fragile, delicate, and/or expensive objects.

Where objects are office components (e.g., such as a computer, monitors, keyboard, mouse, power cords, adaptors, converters, and so forth), the present invention is ideal for all-in-one transportation of a user's essential office equipment from one location to another (e.g., a mobile office). The present invention is particularly well suited for users who travel for work, or who have similar lifestyles. I user may pack up the office essentials into the present invention, take it with them to their next location, unpack and set up their office at any new location where the user desires to accomplish work and/or personal, computer-related tasks.

Figure 1:
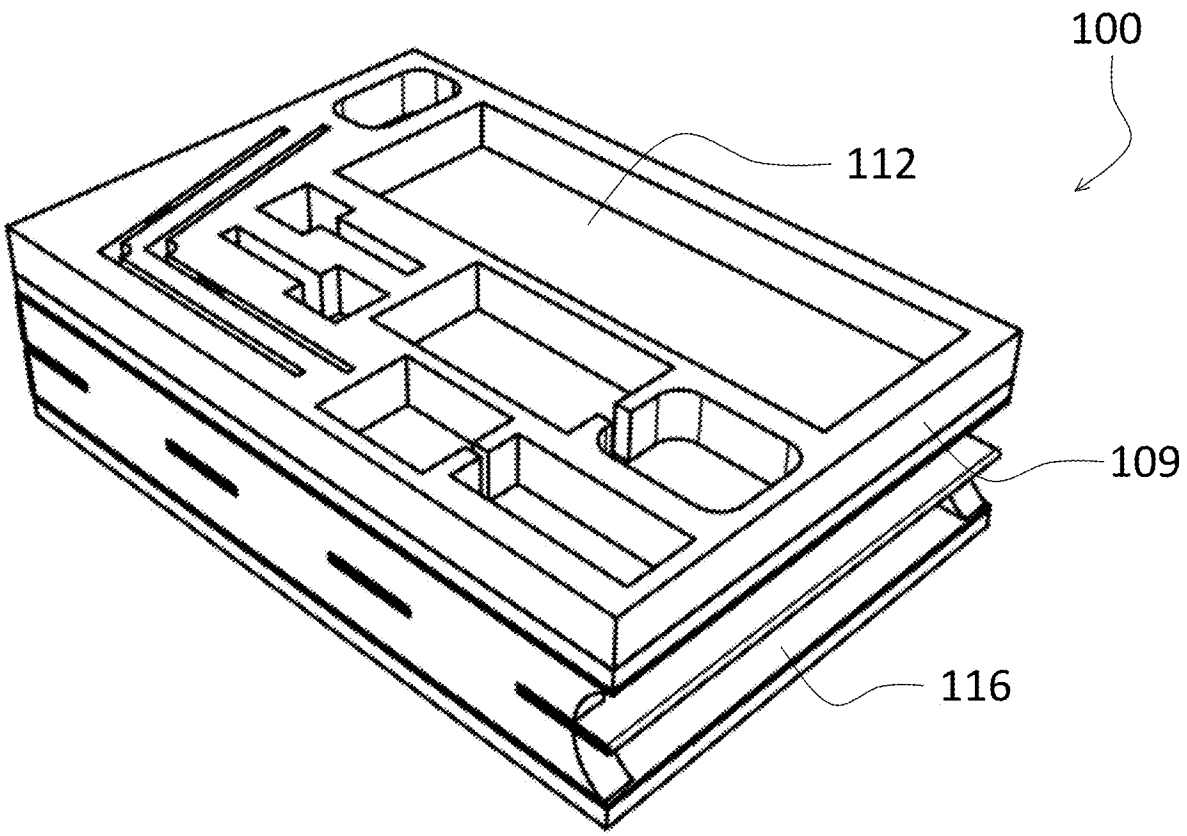
FIG. 1 illustrates a perspective view of a luggage insert according to the present invention.
Figure 3:
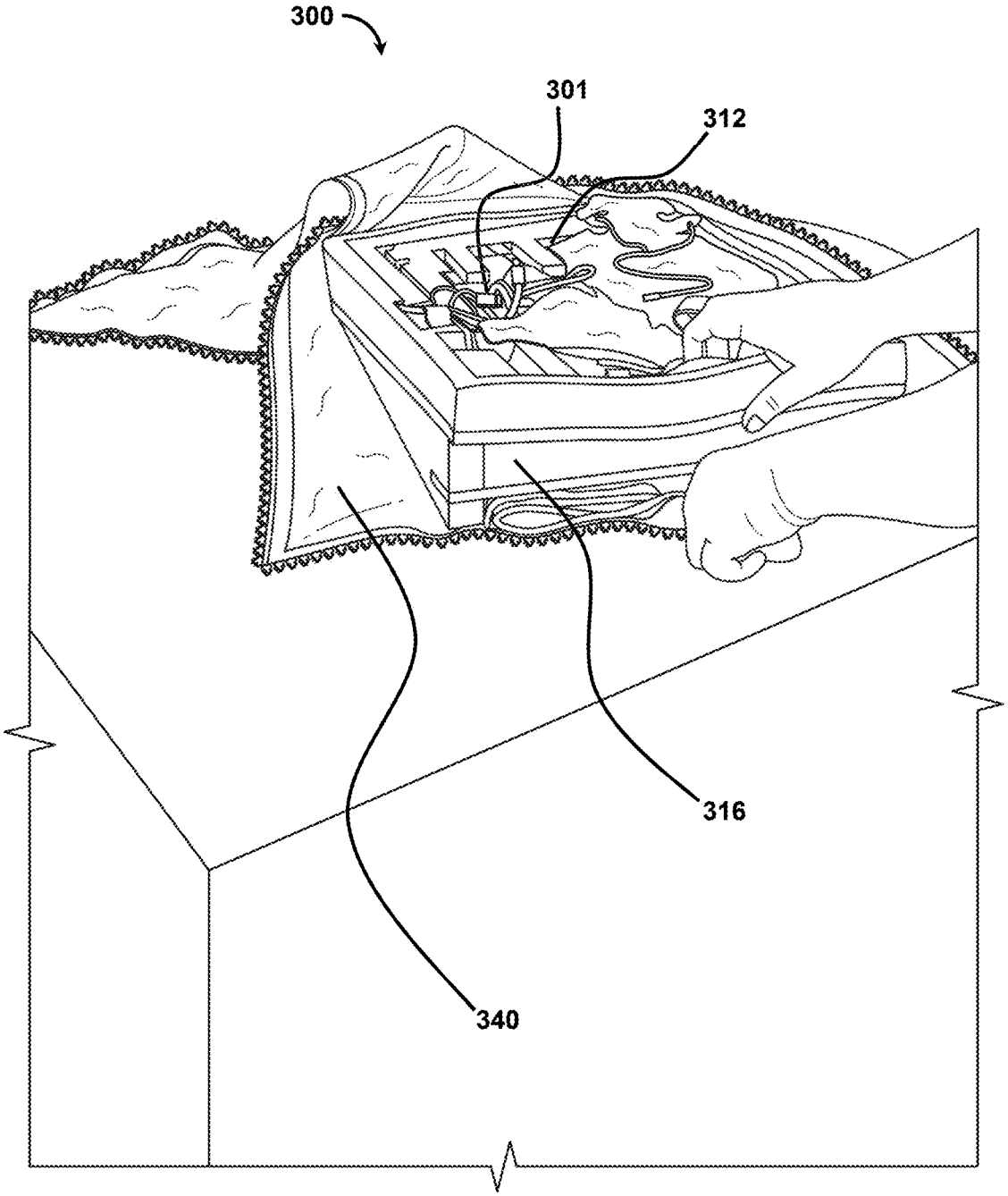
FIG. 3 illustrates a perspective view of a luggage insert placed in an open insert bag.

FIG. 1 illustrates a luggage insert 100 for retaining objects (e.g., objects 301 of FIG. 3). The luggage insert 100 may have a body 109. The luggage insert 100 may be formed having one or more openings formed in body 109 for receiving objects (e.g., 1, 2, 3, 4, 5, 6, 7, 8, 9, 10, 11, 12, 13, 14, or more openings). Each opening may receive one or more objects and/or a plurality of openings may receive a single object. The openings may extend partially and/or completely through a dimension of luggage insert 100. The openings may include top openings (e.g., opening 112) and/or lateral openings (e.g., opening 116).

The openings may be shaped and/or dimensioned to appropriately fit (e.g., snuggly) specific objects (e.g., electronic devices, power converters, wiring bundles, jewelry, various works of art, and so forth). Objects may include computer equipment, such as, without limitation, monitors, monitor stands, keyboards, mice, webcams, USB hubs, power outlets, connective wiring, and so forth. Opening 112 may be shaped and/or dimensioned to snuggly fit a computer keyboard. Opening 116 may be shaped and/or dimensioned to snuggly fit a laptop computer and/or a desktop monitor.

Luggage insert 100 may be formed of one or more materials (e.g., 1, 2, 3, 4, 5, or more different materials). Luggage insert 100 may be formed of any one or more of polyurethane, polystyrene, polypropylene (e.g., corrugated sheets), latex, fiberglass, ethylene-vinyl acetate, biopolymers, and/or mineral filled products. Luggage insert 100 may include metallic components (e.g., to provide structure and/or to create a faraday cage around the objects.

Figure 2:
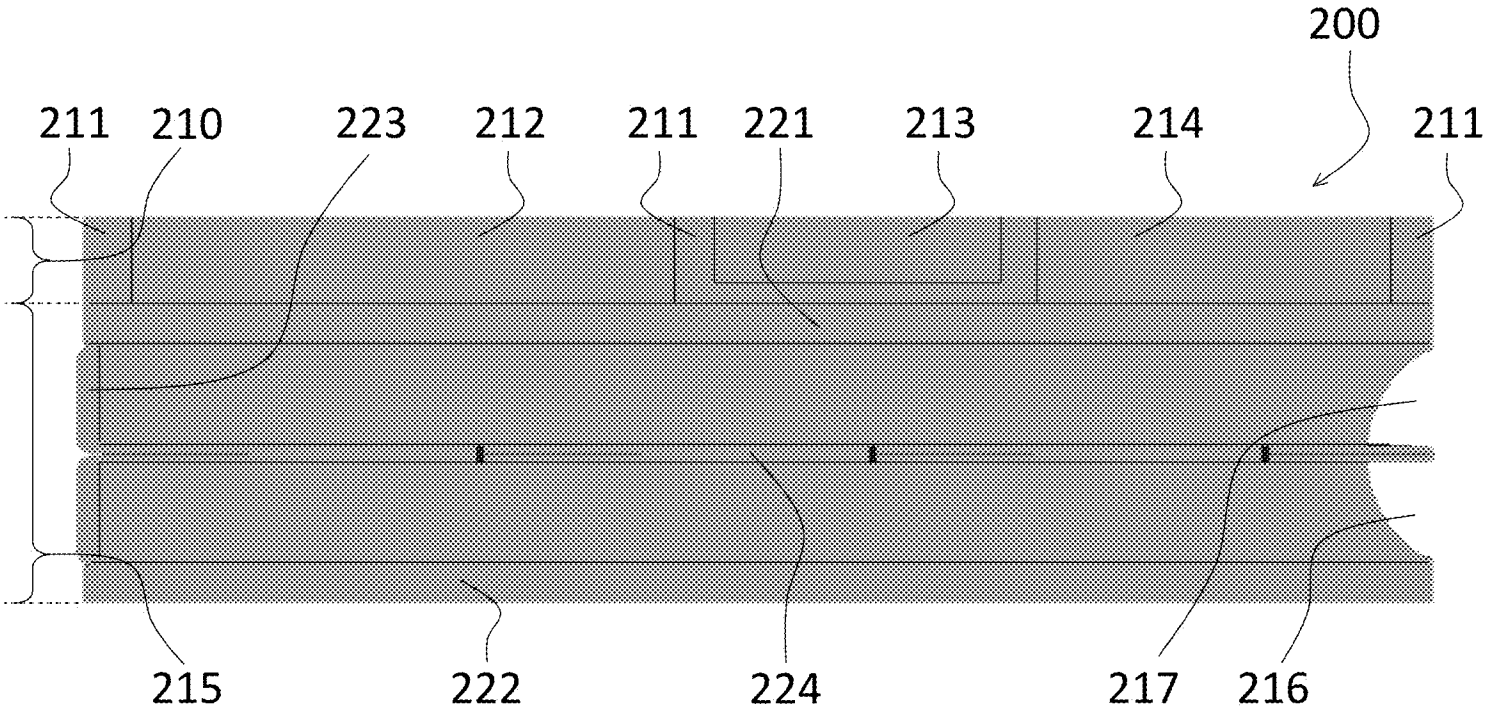
FIG. 2 illustrates a cross-sectional view of a luggage insert.

FIG. 2 illustrates a luggage insert 200 for retaining objects (e.g., objects 301 of FIG. 3). Luggage insert 200 may include one or more layers (e.g., 1, 2, 3, 4, 5, or more layers), where each layer is configured to receive specific objects. Luggage insert 200 may include one or more top layers 210 (e.g., having top, bottom, and/or vertical openings). Luggage insert 200 may include one or more lateral layers 215 (e.g., having lateral and/or horizontal openings). Luggage insert 200 may include one top layer 210 and one lateral layer 215. Luggage insert 200 may include one top layer 210 and a plurality of lateral layers 215. Luggage insert 200 may include a plurality of top layers 210 and one lateral layer 215. Luggage insert 200 may include a plurality of top layers 210 and a plurality of lateral layers 215. The one or more top layers 210 and the one or more lateral layers 215 may be organized and/or sequenced in any order.

Top layers 210 may include a material layer 211 with one or more openings (e.g., top openings 212, 213, 214) extending partially and/or completely through the material layer 211. Top opening 212 may extend completely through material layer 211 (e.g., creating an aperture that extends to the lateral layer 215). Top opening 213 may extend partially through material layer 211. Top opening 214 may extend completely through material layer 211. Top layers 210 may include any number of complete and partial openings.

Lateral layers 215 may include a top wall 221, a bottom wall 222, and/or one or more sidewalls 223 (e.g., forming an open interior). One side (e.g., a front side) of lateral layers 215 may be open (e.g., allowing access to the open interior). One or more dividers 224 may be positioned between top wall 221 and bottom wall 222 and/or between the one or more sidewalls 223 (e.g., to divide the open interior into two or more openings). The open interior may be divided into two or more openings (e.g., horizontal and/or vertical openings). Divider 224 is exemplified as extending horizontally to create two horizontal openings positioned top over bottom.

Lateral layers 215 may be formed of one or more corrugated sheets of polypropylene. A sheet may extend from lower lateral opening 216 rearwardly to sidewall 223 to form bottom wall 222. A sheet may extend up from bottom wall 222 to divider 224 to form a lower segment of sidewall 223. A sheet may extend forward from sidewall 223 to lateral opening 216 to form divider 224. A sheet may extend rearwardly from upper lateral opening 217 to sidewall 223 to form divider 224. A sheet may extend up from divider 224 to top wall 221 to form an upper segment of sidewall 223. A sheet may extend forward from sidewall 223 to upper lateral opening 217 to form top wall 221. A single sheet may extend across all of the paths indicated in this paragraph. Foam blocks may be placed between the bottom wall 222 and divider 224 and/or between top wall 221 and divider 224 (e.g., along sidewalls thereof) to keep adequate spacing of the sheets during use of luggage insert 200 (e.g., ensuring that lower and upper lateral openings 216, 217 remain open and non-compressed).

The open side of lateral layers 215 may enable access from the exterior of luggage insert 200 into the open interior (e.g., via lateral openings). Positioning the one or more dividers 224 within the open interior may likewise divide the lateral openings into two or more lateral openings (e.g., bifurcating the open interior into a lower lateral opening 216 and/or an upper lateral opening 217). Lower and upper lateral openings 216, 217 are exemplified as being approximately similar in dimension, however, lower and upper lateral openings 216, 217 may have different dimensions (e.g., different height dimensions).

The various components of top layer 210 and/or lateral layer 215 may be fastened by suitable means (such as, without limitation, sonic welding, glue, tongue and groove, mortise and tenon, dovetail, formed integrally, and so forth). The one or more dividers 224 may be retained in place within the open interior (e.g., utilizing one or more of the above fastening means). In FIG. 1, the divider is exemplified having tabs which interconnect with slots in a sidewall of the lateral layer. The slots and tabs are visible around a portion of the perimeter of the luggage insert 200.

The various elements of luggage insert 200 (e.g., the components forming top layer 210 and lateral layer 215) may be formed of similar and/or different materials having different hardness and/or softness. Each component may be formed of layers including a plurality of different materials (e.g., having a firmer core for structure and/or a softer exterior for cushioning objects placed in the luggage insert 200. Top layer 210 may be formed of the same material as lateral layer 215. Top layer 210 may be formed of different material as lateral layer 215. Top layer 210 may be formed of the same material as lateral layer 215.

FIG. 3 illustrates a luggage insert 300 retaining a number of objects (e.g., objects 301). The luggage insert 300 may receive objects into a plurality of top openings 312 and/or into a plurality of lateral openings 316. FIG. 3 exemplifies a plurality of electronic components, wiring bundles, and power converters placed into various openings of the luggage insert 300. More fragile, delicate and/or expensive objects may be placed in a protective sack (e.g., a static resistant sack) to protect the electronic components, wiring bundles, and power converters from accidental electrical discharge.

Objects may be positioned in luggage insert 300 by sliding the objects into any available opening. Larger, flat objects (e.g., laptops, monitors) may be slid horizontally into lateral opening 316. Smaller objects (tablet, keyboard, mouse, cables, power converters, and so forth) may be slid vertically into top opening 312.

An insert bag 340 may extend partially or completely around luggage insert 300 when closed. Insert bag 340 may extend partially around luggage insert 300 when open. Insert bag 340 may be entirely removed (e.g., luggage insert 300 may be decoupled and/or removed from insert bag 340. Insert bag 340 may be secured in a closed position by any suitable fastener (e.g., by zipper, strap, buckle, bungee, button, hook and loop fastener, tie, clasp, magnetic clasp, and so forth). Insert bag 340 may enable the retention of objects within luggage insert 300 during movement thereof.

Figure 4:
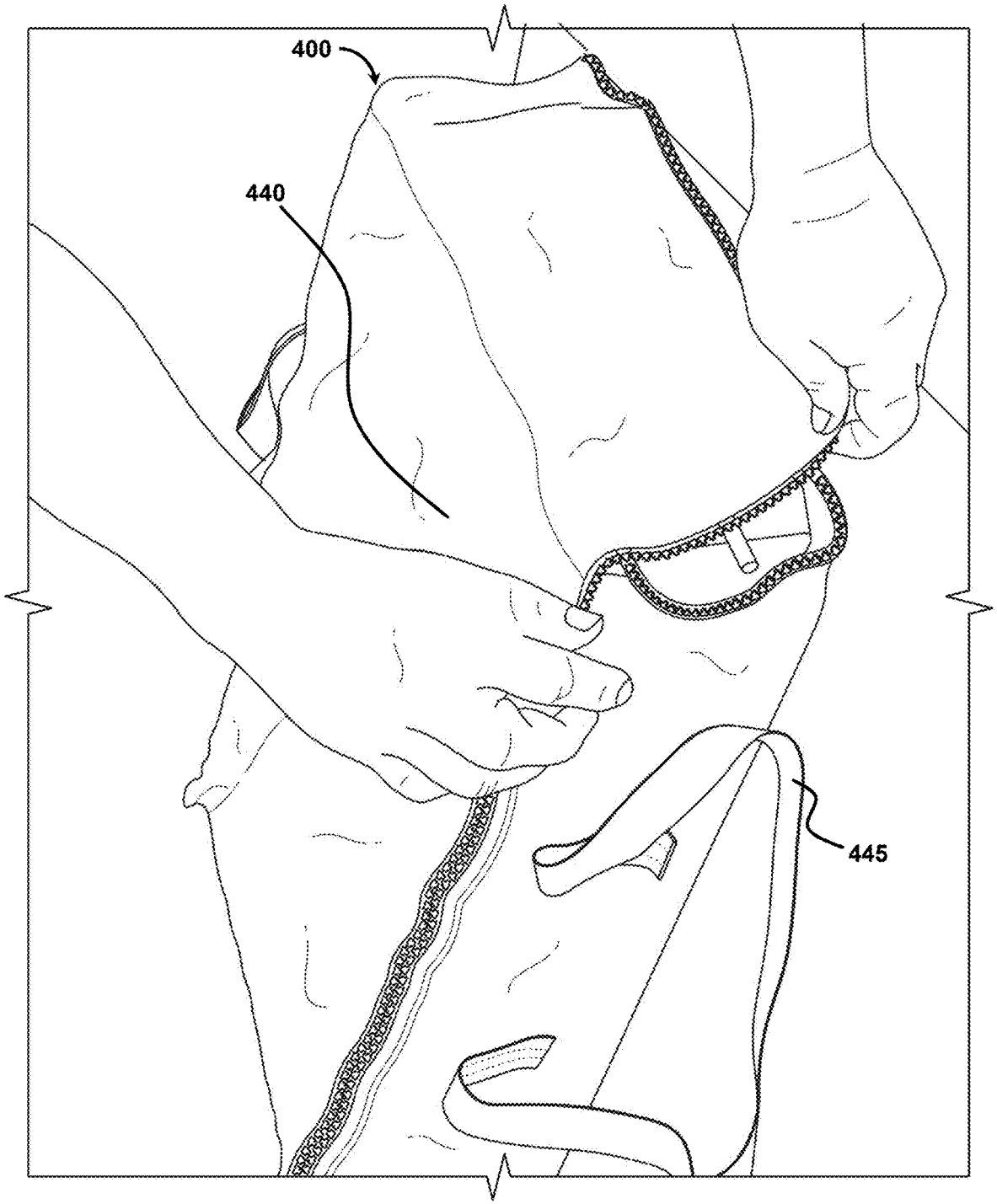
FIG. 4 illustrates a perspective view of an insert bag enclosed around a luggage insert.

FIG. 4 illustrates an insert bag 440 enclosed around a luggage insert 400 (e.g., secured by a zipper). Insert bag 440 may be loose or form-fitting (e.g., fitting snuggly around luggage insert 400). Insert bag 440 may be formed of stretchable and/or non-stretchable material. Insert bag 440 may be formed of fabric, canvass, or other woven and/or non-woven material formed of natural and/or synthetic fibers. Insert bag 440 may be resistant to electrical discharge, moisture, impact, or other conditions that may jeopardize objects contained within luggage insert 400. Insert bag 440 may be a single layer of material or formed by multiple layers of material (e.g., two layers of material with a padded material between the two layers).

Insert bag 440 may include one or more straps 445 (e.g., 1, 2, 3, 4, 5, or more straps) to enable the ease of carrying insert bag 440 during transportation thereof.

Figure 5:
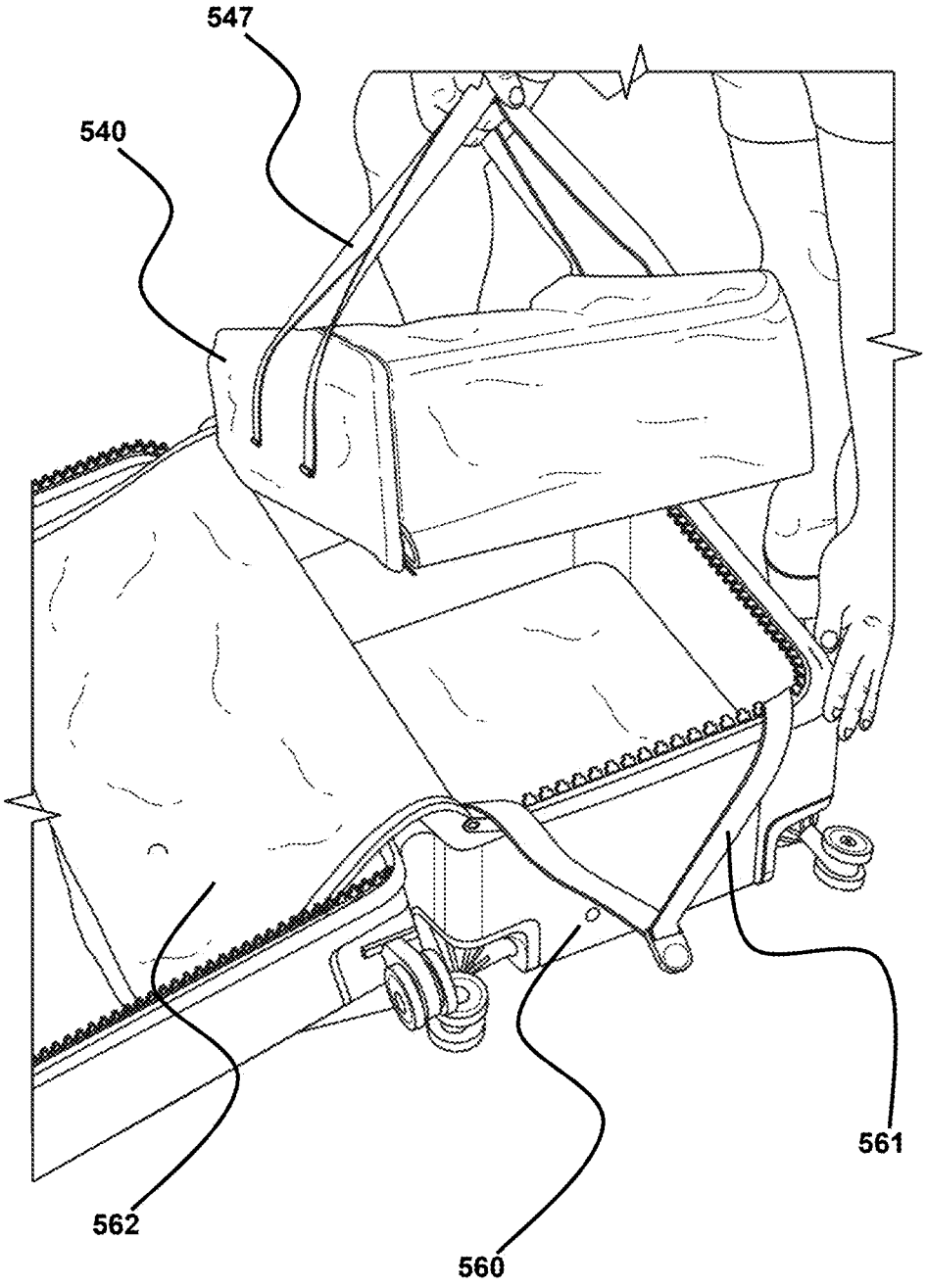
FIG. 5 illustrates a perspective view of an item of luggage prepared to receive an insert bag containing a luggage insert.

FIG. 5 illustrates an item of luggage 560 prepared to receive an insert bag 540 (e.g., into an interior) containing a luggage insert (e.g., luggage insert 100 of FIG. 1). Insert bag 540 and/or the luggage insert may be dimensioned to fit within item of luggage 560. Yet, items of luggage may be any size in a wide array of sizes. Therefore, insert bag 540 may be larger or smaller than the interior space of some items of luggage.

Insert bag 540 may be equipped with one or more air pockets throughout the surface area of insert bag 540. After insert bag 540 is placed in the interior space of an item of luggage 560, the air pockets may be inflated so that insert bag 540 and/or the luggage insert may be retained securely between the sidewalls of the item of luggage 560. Alternatively, sheets of foam, padding, or other material (e.g., the user's clothing) may be packed into the interstitial space between insert bag 540 and the item of luggage 560 to retain insert bag 540 and/or the luggage insert within the item of luggage 560 (e.g., a foam insert of custom dimensions). The above mode of securement may provide the added benefit of adding additional cushion and/or protection around insert bag 540. Alternatively, the item of luggage 560 may be equipped with integral straps 561 (e.g., connectable by a snap and/or buckle) and/or flaps 562 (e.g., opened and closed by a zipper) secured within and/or formed integrally with luggage 560 for strapping the insert bag 540 into a secured position within the item of luggage 560.

Insert bag 540 may include one or more handles (e.g., straps 547). That assist in moving, lifting, and/or lowering insert bag 540. Insert bag 540 may be lifted from and/or lowered into the item of luggage 560. Insert bag 540 may be transported in the interior of the item of luggage 560. Insert bag 540 may be moved by grabbing straps 547 and moving insert bag 540 to a desired location for packing and/or unpacking (e.g., for office assembly and/or disassembly).

Figure 6:
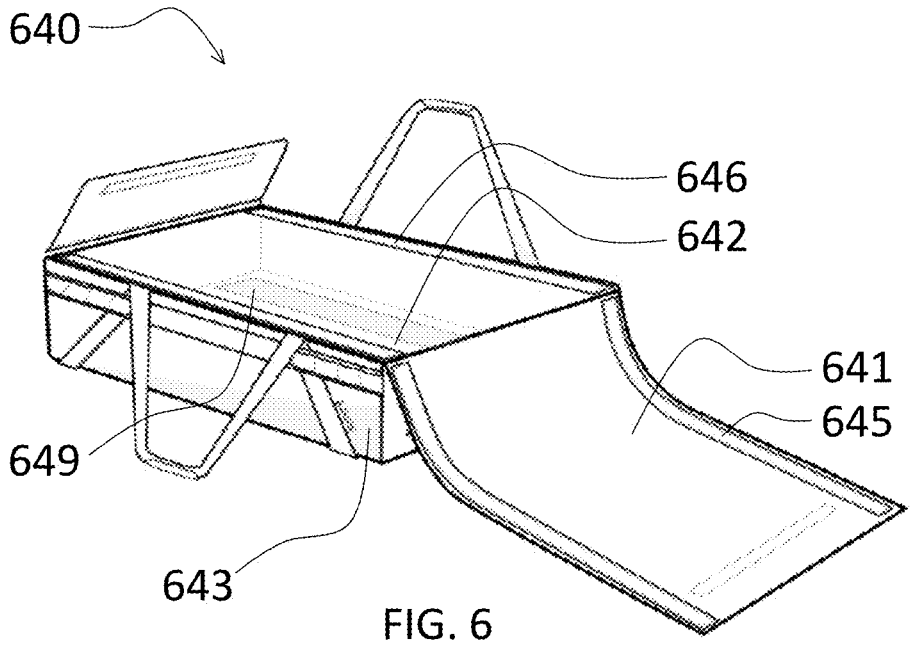
FIG. 6 illustrates a perspective view of an insert bag in an open position.

FIG. 6 illustrates an insert bag 640 capable of receiving a luggage insert (e.g., luggage insert 200 of FIG. 2). Insert bag 640 may be exemplified in an open position. Insert bag 640 may have a top flap 641 (e.g., exemplified in an open position). Insert bag 640 may have sidewalls 643. Insert bag 640 may have a bottom wall 642. Top flap 641, sidewalls 643 and bottom wall 642 may form an enclosure with an open interior for receiving a luggage insert. Insert bag 640 may be formed of a textile material (e.g., woven material, synthetic material, or a blend of both). Insert bag 640 may be formed of a cotton-polyester liner.

Top flap 641 may be permanently attached to sidewalls 643 and/or bottom wall 642 (e.g., via a seam along one or more sides of top flap 641). Top flap 641 may be removably attached to sidewalls 643 and/or bottom wall 642 (e.g., via zipper, hook and loop fasteners, buttons, clasps, magnets, or one or more other securement means). Top flap 641 may have one or more hook and loop fasteners 645 (e.g., strips) along an edge thereof, which may enable securement to a corresponding one or more hook and loop fasteners 646 along an edge of sidewalls 643 and/or bottom wall 642.

The luggage insert may be retained within insert bag 640 by securement means (e.g., as heretofore described). Sidewalls 643 and/or bottom wall 642 may have zippers, hook and loop fasteners, buttons, clasps, magnets, or one or more other securement means to retain luggage insert within insert bag 640. Sidewalls 643 and/or bottom wall 642 may have one or more hook and loop fasteners 649 (e.g., strips) along a surface thereof, which may enable securement to a corresponding one or more hook and loop fasteners on the luggage insert. The luggage insert may be secured by the hook and loop fasteners 649, or removed as desired.

Figure 7:
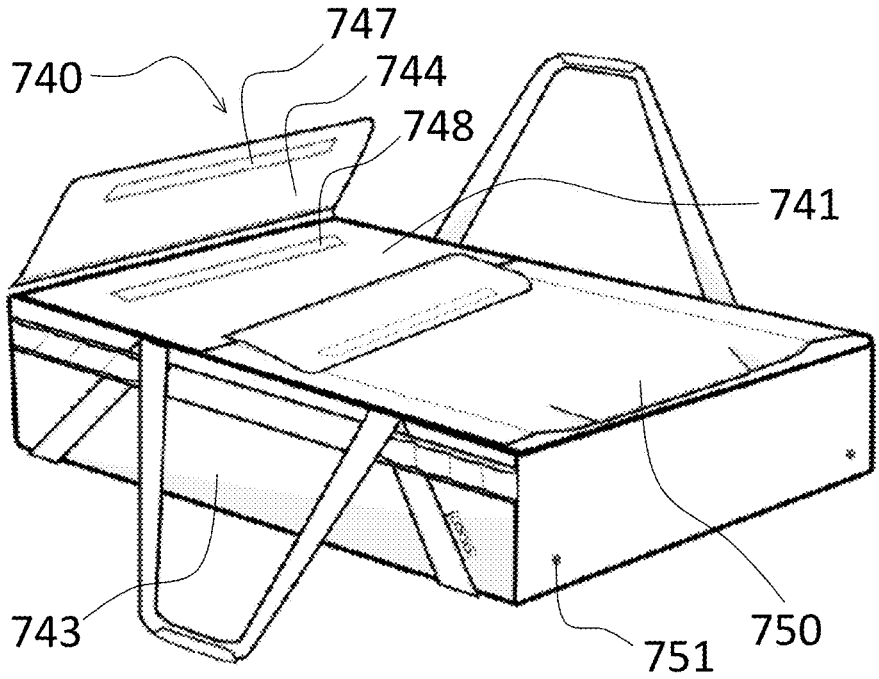
FIG. 7 illustrates a perspective view of an insert bag in a closed position.

FIG. 7 illustrates an insert bag 740 capable of receiving a luggage insert (e.g., luggage insert 300 of FIG. 3). Insert bag 740 may be exemplified in a closed position with a top flap 741 secured over an open interior. A luggage insert may be retained within the open interior. Top flap 741 may be secured to one or both of one or more sidewalls 743 and/or a bottom wall to enclose the luggage insert within the open interior.

Top flap 741 may further be retained by an auxiliary flap 744 (e.g., using securement means described in this disclosure). Auxiliary flap 744 may fold over top flap 741. Auxiliary flap 744 may retain top flap 741 along one side of top flap 741. Auxiliary flap 744 may be permanently affixed to one or more of sidewalls 743 and/or the bottom wall (e.g., via a seam). Auxiliary flap 744 may have one or more hook and loop fasteners 747 (e.g., strips) along an edge thereof, which may enable securement to a corresponding one or more hook and loop fasteners 748 along a surface of top wall 741.

Top flap 741 may have a pocket 750. Pocket 750 may be on an exterior surface of top flap 741. Pocket 750 may be on an interior surface of top flap 741. Pocket 750 may be formed of a textile material (e.g., cotton-polyester blended material).

Insert bag 740 may have one or more grommets 751 (e.g., in sidewalls 743). Grommets 751 may enable insert bag 740 to be retained to another structure (e.g., to an item of luggage).

Having described several embodiments of the invention, various extensions and alternatives may be readily apparent to those of skill in the art. Such extensions and alternatives are considered to be part of the invention, which is only limited by the several claims attached hereto. Other aspects will be apparent to those skilled in the art from consideration of the specification and practice disclosed herein. It is intended, therefore, that the specification and illustrated embodiments be considered as examples only.

What is claimed is:

1. A mobile office, comprising:

an item of luggage defining length, width, and height dimensions, a height of the item of luggage being less than both a length of the item of luggage and a width of the item of luggage, respectively, said height of the item of luggage defining a top side and bottom side of the mobile office apparatus;

a luggage insert sized and dimensioned to removably fit securely within the item of luggage, the luggage insert having a body, the body having a plurality of openings extending into the body, the body including:

a top layer formed of a single, solid layer of material, the plurality of openings including a first top opening extending into the at least one top layer at a top of the body and extending at least partially through the layer of material toward a bottom of the body, the first top opening configured to match and fit a first item of computer equipment, and a lateral layer fixed below the at least one top layer, the plurality of openings further including a first lateral opening extending laterally into the lateral layer at a side of the body, the first lateral opening sized and dimensioned to laterally receive a first monitor display within;

an insert bag extendable around the luggage insert, the insert bag form fitting around the luggage insert to retain the first item of computer equipment and the first monitor display during transportation, the insert bag having an open state and a closed state, said insert bag configured to receive the luggage insert and to provide access to the top opening and to the first lateral opening when in its open state, said insert bag further configured to enclose the luggage insert and close off the plurality of top openings and the first access opening when in its closed state, said insert bag further configured to fit within the item of luggage when the luggage insert is enclosed within the insert bag in said closed state.

2. The mobile office of claim 1, wherein the plurality of openings includes a second lateral opening extending into the lateral layer at the side of the body.

3. The mobile office of claim 1, wherein the first top opening extends less than entirely through the layer of material.

4. The mobile office of claim 1, wherein the plurality of openings includes a second top opening extending into the top layer at a top of the body and extends at least partially through the layer of material, and wherein the second top opening is shaped to fit a second item of computer equipment.

5. The mobile office of claim 4, wherein first item of computer equipment is a keyboard, and the second item of computer equipment is a computer mouse.

6. The mobile office of claim 1, wherein the at least one lateral layer is formed of a top wall, a bottom wall, and one or more sidewalls forming an open interior, wherein a divider is positioned within the open interior to bifurcate a second lateral opening from the first lateral opening, said second lateral opening sized and dimensioned to laterally receive a second monitor display.

7. The mobile office of claim 1, wherein the insert bag includes one or more handles for moving the insert bag into the item of luggage.

8. A mobile office apparatus comprising an item of luggage defining length, width, and height dimensions, a height of the item of luggage being less than both a length of the item of luggage and a width of the item of luggage, respectively, said height of the item of luggage defining a top side and bottom side of the mobile office apparatus;

a luggage insert sized and dimensioned to removably fit securely within the item of luggage, the luggage insert including:

a top layer including a plurality of top cavities extending downward into and terminating within said top layer, each top cavity having a top opening configured to provide access to said top cavity from above, each top cavity configured to fit an item of computer equipment, and a lateral layer fixed to and extending below and therefrom the top layer, said lateral layer including a first lateral cavity extending laterally into and terminating within said lateral layer, said first lateral cavity having a first side opening configured to provide access to the first lateral cavity from an access side that is perpendicular to the top side, the first lateral cavity sized and dimensioned to laterally receive a first monitor display within;

an insert bag having an open state and a closed state, said insert bag configured to receive the luggage insert and to provide access to the top opening and to the first lateral opening when in its open state, said insert bag further configured to enclose the luggage insert and close off the plurality of top openings and the first access opening when in its closed state, said insert bag further configured to fit within the item of luggage when the luggage insert is enclosed within the insert bag in said closed state.

9. The mobile office apparatus of claim 8, wherein the length of the item of luggage is greater than the width of the item of luggage;

wherein the item of luggage has a clamshell configuration having a first half shell and a second half shell, and the clamshell configuration is configured to open along its length on a first side and to pivot along its length on a second side opposite said first side;

wherein the luggage insert enclosed within the insert bag together are sized and dimensioned to fit within the first half shell of the item of luggage; and wherein the item of luggage includes a securing means configured to secure the luggage insert enclosed within the insert bag together into a secured position within the first clamshell of the item of luggage.

10. The mobile office apparatus of claim 8, wherein a first cavity of the plurality of top cavities of the top layer of the luggage insert is sized and dimensioned to securely receive a computer keyboard;

wherein a second cavity of the plurality of top cavities of the top layer of the luggage insert is sized and dimensioned to securely receive a computer mouse; and wherein a third cavity of the plurality of top cavities of the top layer of the luggage insert is sized and dimensioned to securely receive a computer power supply.

11. The mobile office apparatus of claim 10, wherein a fourth cavity of the plurality of top cavities of the top layer of the luggage insert is sized and dimensioned to securely receive a first computer monitor stand.

12. The mobile office apparatus of claim 11, wherein a fifth cavity of the plurality of top cavities of the top layer of the luggage insert is sized and dimensioned to securely receive a second computer monitor stand;

wherein the lateral layer further includes a second lateral cavity below the first lateral cavity; said second lateral cavity extending laterally into and terminating within said lateral layer, said second lateral cavity having a second side opening configured to provide access to the second lateral cavity from the access side, said second lateral cavity sized and dimensioned to laterally receive a second monitor display within; and wherein the insert bag is further configured to close off the second access opening when in its closed state.

13. The mobile office apparatus of claim 8, wherein the first lateral cavity of the lateral layer is configured to cushion the first monitor display while within said first lateral cavity.

14. The mobile office apparatus of claim 8, wherein the insert bag includes a top flap fixed to the insert bag at one end and removably coupled to the insert bag at an opposite end, said top flap configured to provide access to both of the top opening and to the first lateral opening when said top flap is decoupled from said opposite end.

15. The mobile office apparatus of claim 8, wherein the insert bag is further configured to be retained securely in-between opposing sidewalls within the item of luggage.

16. The mobile office apparatus of claim 15, wherein the insert bag includes at least one inflatable air pocket configured to secure the insert bag within the item of luggage when inflated.

17. The mobile office apparatus of claim 16, wherein the length of the item of luggage is greater than the width of the item of luggage;

wherein the item of luggage has a clamshell configuration having a first half shell and a second half shell, and the clamshell configuration is configured to open along its length on a first side and to pivot along its length on a second side opposite said first side;

wherein the luggage insert enclosed within the insert bag together are sized and dimensioned to fit within the first half shell of the item of luggage;

wherein the item of luggage includes a securing means configured to secure the luggage insert enclosed within the insert bag together into a secured position within the first clamshell of the item of luggage;

wherein a first cavity of the plurality of top cavities of the top layer of the luggage insert is sized and dimensioned to securely receive a computer keyboard;

wherein a second cavity of the plurality of top cavities of the top layer of the luggage insert is sized and dimensioned to securely receive a computer mouse;

wherein a third cavity of the plurality of top cavities of the top layer of the luggage insert is sized and dimensioned to securely receive a computer power supply;

wherein a fourth cavity of the plurality of top cavities of the top layer of the luggage insert is sized and dimensioned to securely receive a first computer monitor stand;

wherein a fifth cavity of the plurality of top cavities of the top layer of the luggage insert is sized and dimensioned to securely receive a second computer monitor stand;

wherein the lateral layer further includes a second lateral cavity below the first lateral cavity; said second lateral cavity extending laterally into and terminating within said lateral layer, said second lateral cavity having a second side opening configured to provide access to the second lateral cavity from the access side, said second lateral cavity sized and dimensioned to laterally receive a second monitor display within;

wherein the insert bag is further configured to close off the second access opening when in its closed state; wherein the first lateral cavity of the lateral layer is configured to cushion the first monitor display while within said first lateral cavity; and wherein the insert bag includes a top flap fixed to the insert bag at one end and removably coupled to the insert bag at an opposite end, said top flap configured to provide access to both of the top opening and to the first lateral opening when said top flap is decoupled from said opposite end.

* * * * *